US005978632A

United States Patent [19]

Kimura et al.

[11] Patent Number: 5,978,632

[45] Date of Patent: Nov. 2, 1999

[54] TONER CARTRIDGE

[75] Inventors: Takahiko Kimura, Ikoma; Hideji Saiko, Kitakatsuragi-gun; Yoshiaki Sanada; Jun Yamaguchi, both of Ikoma; Eiji Sato, Yamatokoriyama; Yasuyuki Ishiguro, Higashiosaka, all of Japan

[73] Assignee: Sharp Kabushiki Kaisha, Osaka, Japan

[21] Appl. No.: 09/058,808

[22] Filed: Apr. 13, 1998

[30] Foreign Application Priority Data

Apr. 14, 1997 [JP] Japan ..... P9-095386

[51] Int. Cl.[6] ..... G03G 15/08

[52] U.S. Cl. ..... 399/263; 222/409; 222/DIG. 1

[58] Field of Search ..... 399/261, 262, 399/263, 258; 222/DIG. 1, 409, 410, 411, 533, 535; 366/243

[56] References Cited

U.S. PATENT DOCUMENTS

| | | | |
|---|---|---|---|
| 4,456,364 | 6/1984 | Hatzis | 399/263 |
| 4,696,418 | 9/1987 | Kurotaka et al. | 222/167 |
| 5,030,997 | 7/1991 | Michlin et al. | 399/106 |
| 5,270,785 | 12/1993 | Kita et al. | 399/261 |
| 5,652,944 | 7/1997 | Masuda et al. | 399/24 |

FOREIGN PATENT DOCUMENTS

| | | |
|---|---|---|
| 61-116373 | 6/1986 | Japan . |
| 164458 U | 11/1989 | Japan . |
| 5-297709 | 11/1993 | Japan . |
| 6-194949 | 7/1994 | Japan . |
| 7-043997 | 2/1995 | Japan . |
| 8-044174 | 2/1996 | Japan . |

*Primary Examiner*—Robert Beatty

[57] ABSTRACT

The invention is characterized by efficiently and quickly loosening an aggregation of toner material formed in a toner cartridge. A toner cartridge has an L-shaped toner agitating member disposed in a main body thereof having a discharge port for feeding toner at the front surface of the main body. Since the toner agitating member is supported so as to pivot like a conical pendulum, a support pin fixed to a bottom surface of the main body passes through a through hole having a greater diameter than that of the support pin. The support pin has an engagement portion attached thereto for prevention of disengagement of the toner agitating member therefrom. A plate-like portion of the toner agitating member defines an agitating plate, a distal end of which extends toward the discharge port of the main body. Shaking the toner cartridge causes the agitating member to rotate about the support pin and to pivot in a direction parallel to the axis of the support pin like a conical pendulum, thereby efficiently loosening the aggregated toner material.

15 Claims, 8 Drawing Sheets

TONER CARTRIDGE

BACKGROUND OF THE INVENTION

1. Field of the Invention

The present invention relates to a toner cartridge for replenishing a development device with a toner material of a colorant for developing an electrostatic latent image into a visible image, the development device provided in an electrophotographic type image forming apparatus, such as copiers, printers and the like, for developing the electrostatic latent image formed on a recording medium into the visible image.

2. Description of the Related Art

The electrophotographic type image forming apparatuses such as copiers, printers and the like, are adapted to form an electrostatic latent image corresponding to an image to be reproduced on a surface of a photosensitive material as a recording medium. The image forming apparatus comprises a development device for developing the electrostatic latent image into the visible image. The development device is adapted to supply a developer such as toner material of a colorant to the photosensitive material and to make the toner material adhere to the photosensitive material.

More specifically, in the image forming apparatus, the surface of the photosensitive material is first uniformly electrically charged and then irradiated with a light image corresponding to an image to be reproduced thereby removing the electric charge of the surface of the photosensitive material in a region irradiated with the light image. As a result, the electrostatic latent image is formed in correspondence to the image to be reproduced. For developing the electrostatic latent image into the visible image, the development device makes the toner adhere to the surface of the photosensitive material. Thus, the toner stored in the development device is consumed little by little on each production of a printed image.

In order to maintain the quality of images produced by the image forming apparatus at a certain level, the development device needs to be replenished with toner so as to make up for the consumption. In addition, the image forming apparatus is designed to store a constant amount of toner material at all times. On this account, the development device includes a toner feeder which is responsive to a detection of shortage of the toner material contained in the development device for automatically feeding a toner material to the development device. This ensures that the constant amount of toner material is kept constant in the development device thereby constantly maintaining a consistent level of quality of the produced images.

The toner feeder is to be preliminarily supplied with a sufficient amount of toner material. However, the toner feeder runs out of the toner material contained therein on each production of several thousands to tens of thousands of images, requiring a replenishment of toner material. The replenishment of toner material is normally conducted by a person such as a user manipulating the image forming apparatus. In this connection, the toner feeder adopts a toner cartridge system so as to afford convenience to the user who replenishes the toner feeder with a toner material.

FIG. 9 shows a typical construction of the toner cartridge for use in the electrophotographic type image forming apparatuses such as copiers, printers and the like. A toner cartridge 100 of a container such as formed of a resin material is filled with a toner material 101. The toner cartridge 100 has a toner discharge port 103 for feeding the toner material 101 to a hopper 110 of a toner feeder 102 provided in the image forming apparatus. The toner discharge port 103 is usually sealed with a sealing member or the like for prevention of toner leakage and thus, an interior of the toner cartridge 100 is hermetically enclosed.

To replenish the development device with the toner material in the toner cartridge 100, a user first mounts the toner cartridge 100 to the toner feeder so that the toner discharge port 103 fits in an inlet port 104 of the toner feeder 102. Subsequently, the user removes the sealing member closing the toner discharge port 103. Thus, the toner discharge port 103 is opened to be communicated with the inlet port 104 so that the toner material in the toner cartridge 100 is fed to the hopper 110 of the toner feeder 102.

This process needs to be performed smoothly and must ensure that all the toner material 101 in the toner cartridge 100 is fed to the hopper 110 positively and quickly. In other words, the process is required to save as much effort paid by the user as possible and to reduce work needed for the toner replenishment thereby saving time spent by the user involved in operations associated with the image forming apparatus.

Unfortunately, however, the toner cartridge 100 is placed on a floor of a store place for storage as standing on its bottom plate 105 opposite to the toner discharge port 103. Accordingly, as the toner cartridge is left standing over an extended period of time, the gravity causes subsidence of the toner material 101 contained therein so that the aggregation thereof occurs due to forces between toner particles such as Van der Waals force, Coulomb force due to static electricity, liquid crosslinking force and the like. Therefore, it is generally required in the art to sufficiently loosen the aggregated toner material 101 contained in the toner cartridge 100 left standing over an extended period of time so as to efficiently feed such a toner material 101 to the hopper 110 of the toner feeder 102.

Where fine particles like toner particles form aggregation, the aggregation of the fine particles exhibits a behavior similar to that of a solid matter. Therefore, if the toner cartridge 100 containing the aggregated toner material is mounted to the hopper 110 of the toner feeder 102 and the sealing member thereof is removed, the toner material does not flow through the toner discharge port 103, thus failing to be supplied to the hopper 110. Particularly, the aggregated toner material blocks the toner discharge port 103 or the inlet port 104 thereby making it difficult to feed the toner material 100. If, in this state, the user removes the toner cartridge 110 from the hopper 110 mistakenly determining that the toner feeding has been completed, the blocking toner material will be scattered around and a large amount of toner material remaining in the toner cartridge 100 will be discharged out of the cartridge.

For this reason, it is important for the user to shake vertically and laterally the toner cartridge 100 having been left standing so as to adequately loosen the aggregated toner material before mounting the toner cartridge to the hopper 110 and removing the sealing member. However, since the shaking of the toner cartridge 100 varies in degrees from one user to another, the aggregated toner material may sometimes fail to be adequately loosened. In such cases, the toner particles may be scattered around or discharged out of the cartridge, resulting in contamination of hands or clothes of the user.

Furthermore, mere shaking of the toner cartridge cannot bring all the aggregated toner material back to a particle state and hence, a part of the aggregated toner material remains yet to be loosened. When such a toner material is supplied to the toner feeder 102, a great portion of the toner material is left in the toner cartridge 100, resulting in the aforementioned problems. That is, if the user mistakenly removes the toner cartridge 100 when all the toner material therein has not been transferred to the hopper 110 of the toner feeder 102 yet, the toner scattering may result.

Hence, need exists for loosening the toner material aggregated in the toner cartridge 100 due to gravity and the like before the toner material is fed to the toner feeder 102. Although the manufacturers suggest that users shake the toner cartridge 100 adequately so as to loosen the toner material therein, some of many and unspecified users may fail to give the toner cartridge an adequate shake for loosening the toner material, as described above. In the case that the shake for loosening the toner material is inadequate, when the toner cartridge 100 is mounted to the hopper 110 of the toner feeder and the sealing member is removed from the toner cartridge so to start feeding the toner material to the toner feeder, inadequately loosened toner material by shaking may result in cases where all the toner material in the toner cartridge is not transferred to the toner feeder 102 or where a long period of time is required for replenishing the toner feeder with the toner material.

In this connection, a toner feeder designed to efficiently loosen such an aggregation of toner material and to provide a positive and quick toner feeding is disclosed in Japanese Unexamined Utility Model Publication JP-A 1-164458 (1989). As shown in FIG. 9, this toner feeder comprises residual toner removing means 106 pivotally provided in the toner cartridge 100. The residual toner removing means 106 comprises a support member 107 having one end thereof fixed to the cartridge 100 and a weight 109 attached to the support member by way of a coupling member 108 shaped like a coil.

Shaking the toner cartridge 100 brings the residual toner removing means 109 into an oscillation by way of a resilient force of the coil spring which is mainly the coupling member 108. This causes the weight 109 to agitate the toner material 101 in the toner cartridge 100 thereby loosening the aggregated toner material. Thus is accomplished an easy and quick toner feeding from the toner cartridge 100 to the toner feeder 102.

As described above, the toner feeder discussed in Japanese Unexamined Utility Model Publication JP-A 1-164458 (1989) contains therein the coil spring as a resilient member and the weight for agitating and loosening the toner material in the toner cartridge. Thus is offered a solution to the problem where the toner feeding leaves a great portion of the toner material in the toner cartridge.

However, it is anticipated that when a greater oscillation than expected is applied to the toner cartridge, the residual toner removing means 106 may break through the sealing member closing the toner discharge port 103 of the toner cartridge 100. Furthermore, in a case where the toner particles enter the coil spring of the coupling member 108 to form an aggregation therein, a sufficient resilient characteristic of the coil spring cannot be obtained. Therefore, an adequate agitation of the toner material is not accomplished, thus leaving a part of the toner material aggregated. Since the coil spring is utilized for bringing the weight into oscillation, the toner particles are prone to form aggregation in space between adjacent turns of the coil spring, thus producing residual toner material.

SUMMARY OF THE INVENTION

It is an object of the invention to provide a toner cartridge utilizing simple means for quickly and efficiently loosening an aggregation of toner material formed in the toner cartridge thereby allowing for quick toner feeding.

It is another object of the invention to provide a toner cartridge capable of quickly and efficiently loosening the aggregation of toner material formed in the toner cartridge thereby bringing back the aggregated toner material to a particle state.

In a first aspect of the invention, a toner cartridge provided with a container for storing a toner material therein for feeding the toner material to a development device of an electrophotographic type image forming apparatus, comprising:

a toner agitating member housed in the container, having a plate-like agitating plate; and a support member attached to an inside of the container for supporting the toner agitating member so as to allow one end of the agitating plate to pivot, wherein a discharge port for discharging the toner material out of the container is formed on the container, and wherein shaking the container causes the other end of the agitating plate to pivot on said one end as a fulcrum.

According to the first aspect of the invention, the toner cartridge is capable of quickly loosening an aggregation of toner material in the container by virtue of the toner agitating member provided therein. The toner agitating member has a simple configuration and particularly is shaped like a flat plate, which serves to adequately loosen the aggregated toner material in an efficient manner. In this case, the toner agitating member, which has a plate-like configuration, is effective to prevent the toner ma trial from remaining in the vicinity of the toner agitating member. Accordingly, the toner cartridge of the invention requires a shorter period of time for the toner feeding than the prior-art toner cartridge utilizing the coil spring.

In a second aspect of the invention, the support member is attached to a bottom surface of the container opposite to the discharge port thereof and adapted to support the toner agitating member in a manner that the agitating plate is caused to pivot on the one end of the agitating plate like a conical pendulum while the other end thereof is opposed to the discharge port.

According to the second aspect of the invention, the support member of the toner cartridge has the aforementioned configuration. Thus, the use of the support member of a simple configuration can bring the toner agitating member into movement of a conical pendulum thereby increasing an effect of loosening the aggregated toner material. More specifically, since the toner agitating member is supported as to pivot like the conical pendulum, the use of the support member of a simple configuration can accomplish an efficient loosening of the aggregated toner material despite the agitating plate of a plate-like configuration. This contributes to reduction of time that the agitating plate requires for loosening the aggregated toner material.

In a third aspect of the invention, the agitating plate has side ends in a width direction thereof formed thinner and sharper than a central portion of the agitating plate.

According to the third aspect of the invention, the agitating plate of the toner cartridge has the aforementioned configuration. Thus, the agitating plate is capable of readily crushing the aggregation of toner material by way of the side ends or sharp portions thereof while moving through the toner material. Particularly at the beginning of the shaking of the toner cartridge, it is difficult to bring the agitating plate into oscillation because the agitating plate is restrained by the aggregated toner material. However, the sharp portions of the agitating plate facilitate the movement of the agitating plate in a direction in which the sharp portions push the toner material. Thus is provided an easy crushing of the aggregated toner material whereby an increased pivoting efficiency of the agitating plate results. Consequently, the aggregated toner material is adequately loosened in a short period of time.

In a fourth aspect of the invention, a part of the agitating plate is cut away.

According to the fourth aspect of the invention, the agitating plate of the toner cartridge has the aforementioned configuration. This reduces resistance of the toner material in the container which is exerted on the agitating plate during the pivotal movement thereof so that the pivoting efficiency is further increased. Additionally, the side ends of the agitating plate in the width direction may be shaped sharper and thinner than a central portion thereof. This further increases the pivoting efficiency of the agitating plate.

In a fifth aspect of the invention, the toner agitating member has a centroid shifted closer to a vicinity of the other end of the agitating plate.

According to the fifth aspect of the invention, the toner agitating member of the toner cartridge has the centroid positioned as described above. To shift the centroid of the toner agitating member, the aforesaid other end of the agitating plate may be made heavier than the one end of the agitating plate. This assists the agitating plate to pivot like the conical pendulum. More specifically, the agitating plate is heavier at its end opposite to the other end thereof constituting a support portion so as to facilitate its pivotal motion. Thus is achieved an increased effect of loosening the aggregated toner material.

In a sixth aspect of the invention, a toner cartridge provided with a container for storing a toner material therein for feeding the toner material to a development device of an electrophotographic type image forming apparatus, comprises:

a toner agitating member housed in the container, having a plate-like agitating plate;

a support member attached to the inside of the container for supporting the toner agitating member so as to allow one end of the agitating plate to pivot; and a restricting plate for restricting a range of a pivotal movement of the agitating plate, wherein a discharge port for discharging the toner material out of the container is formed on the container, and wherein shaking the container causes the other end of the agitating plate to pivot on said one end of the agitating plate as a fulcrum within the range defined by the restricting plate.

According to the sixth aspect of the invention, the toner cartridge further comprises the restricting plate in addition to the toner agitating member and the support member. The restricting plate restricts the moving range of the agitating plate so that when the shaking of the toner cartridge is started, the movement of the agitating plate is restricted to and concentrated in a given direction. This increases an effect of crushing the aggregation of toner material so that the continued shaking of the toner cartridge provides an efficient pivotal movement of the agitating plate. This results in an increased effect of loosening the aggregated toner material thereby allowing for a quick loosening of the toner material.

In a seventh aspect of the invention, the toner agitating member is supported in such a manner that a width direction of the agitating plate is orthogonal to a longitudinal direction of the discharge port and that the restricting plate restricts the range so as to allow the agitating plate to move in the width direction thereof.

According to the seventh aspect of the invention, the toner agitating member and the restricting plate of the toner cartridge have the aforementioned arrangement. Such an arrangement don't align the aforesaid other end of the agitating plate with the discharge port thereby preventing the agitating plate from interfering with the discharge of the toner material. Therefore, the toner feeding is facilitated with reduction of the feeding time.

In an eighth aspect of the invention, the toner agitating member is supported in such a manner that when the toner agitating member stands still, the other end of the agitating plate opposes a portion of the discharge port that shifts from the center of the discharge port.

According to the eighth aspect of the invention, the toner agitating member of the toner cartridge is supported in the aforementioned manner. This prevents the other end of the agitating plate from blocking the discharge port thereby maintaining a preferable condition for discharging the toner material.

In a ninth aspect of the invention, a passage hole is formed in the proximity of the one end of the agitating plate, the passage hole penetrating the agitating plate in a thickness direction thereof.

According to the ninth aspect of the invention, the agitating plate of the toner cartridge has the aforementioned configuration. This reduces resistance of the toner material in the container which is exerted on the agitating plate during the pivotal movement thereof. In addition, the centroid of the agitating plate shifts closer to the other end thereof and hence, the pivoting efficiency is increased.

In a tenth aspect of the invention, a cut-away portion is formed on a longitudinally central part of the side ends of the agitating plate, the cut-away portion penetrating the agitating plate in a thickness direction.

According to the tenth aspect of the invention, the agitating plate of the toner cartridge has the aforementioned configuration. This reduces resistance of the toner material in the container which is exerted on the agitating plate during the pivotal movement thereof and hence, the pivoting efficiency is increased.

In an eleventh aspect of the invention, the container has such a cross-section parallel to the discharge port as progressively decreases toward the discharge port.

According to the eleventh aspect of the invention, the container of the toner cartridge has the aforementioned configuration. This allows the movable range for the toner agitating member to occupy an increased proportion of the total volumetric capacity of the container as compared with a case where the container is a rectangular parallelpiped. Therefore, the toner agitating member is increased in the agitating efficiency.

In a twelfth aspect of the invention, the toner agitating member is supported in such a manner that the agitating plate pivots so that the other end of the agitating plate is abutted against the container.

According to the twelfth aspect of the invention, the toner agitating member of the toner cartridge is supported in the aforementioned manner. This brings the other end of the agitating plate into abutment against an inside wall of the container during the pivotal movement of the agitating plate, thereby applying vibration to the container.

In a thirteenth aspect of the invention, the toner agitating member further comprises a support plate mounted to the one end of the agitating plate and provided with a support hole penetrating through the support plate in a thickness direction thereof, wherein the support member includes a support pin having one end attached to the surface of the container opposite to the discharge port, and an engagement member attached to the other end of the support pin, and wherein the support pin has an outside diameter smaller than an inside diameter of the support hole and a length greater than the thickness of the support plate.

According to the thirteenth aspect of the invention, the toner agitating member and the support member of the toner cartridge have the aforementioned configuration. The use of the support member and toner agitating member of such a simple configuration allows the agitating plate to pivot like the conical pendulum. Accordingly, quite a simple construction of the toner cartridge is provided.

BRIEF DESCRIPTION OF THE DRAWINGS

Other and further objects, features, and advantages of the invention will be more explicit from the following detailed description taken with reference to the drawings wherein:

FIG. 2A is a sectional view of the toner cartridge 1 taken on line A—A in FIG. 1 whereas

FIG. 5A is a front view showing a toner agitating member 4*b* to be mounted to the main body 1*a* of the toner cartridge 1 instead of the toner agitating member 4 of the toner cartridge 1 of FIG. 1 whereas

FIG. 6A is a front view showing a toner agitating member 4*c* to be mounted to the main body 1*a* of the toner cartridge 1 instead of the toner agitating member 4 of the toner cartridge 1 of FIG. 1 whereas

DETAILED DESCRIPTION OF THE PREFERRED EMBODIMENTS

Figure 1:
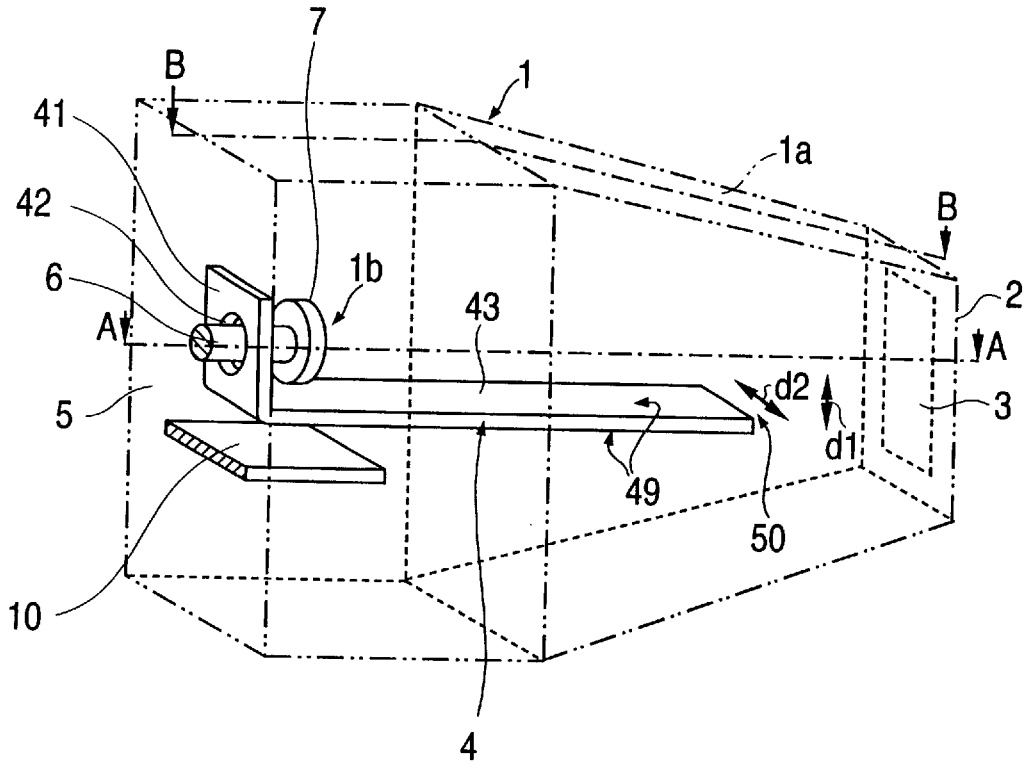
FIG. 1 is a perspective view showing a construction of a toner cartridge 1 according to one embodiment of the invention.

Now referring to the drawings, preferred embodiments of the invention are described below.

Figure 2A:
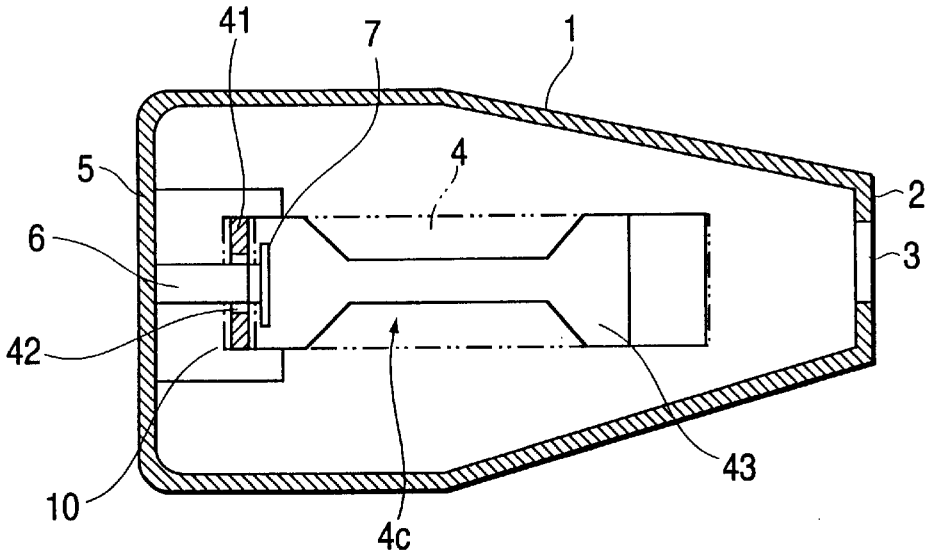
Figure 2B:
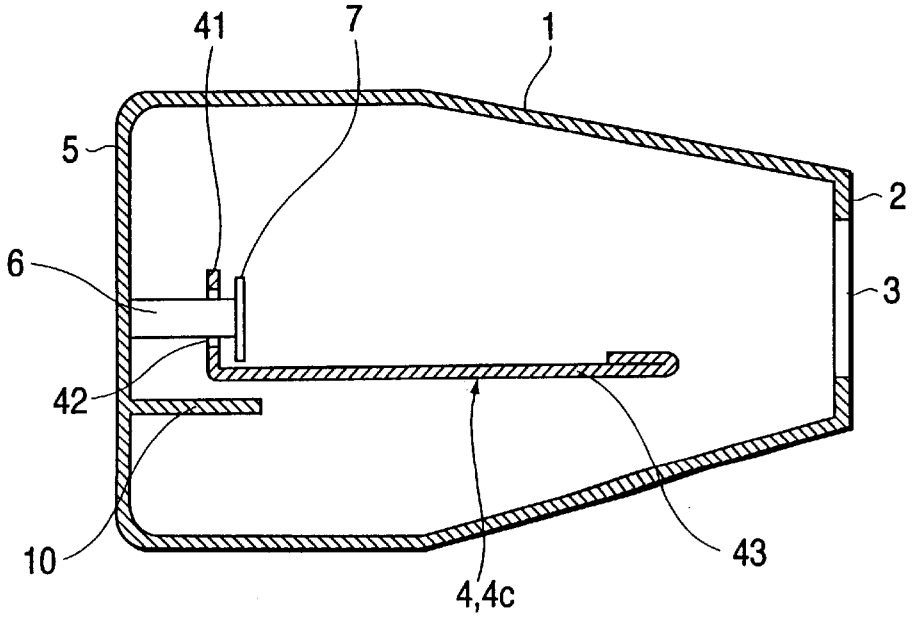
FIG. 2B is a sectional view of the toner cartridge taken on line B—B in FIG. 1.
Figure 3:
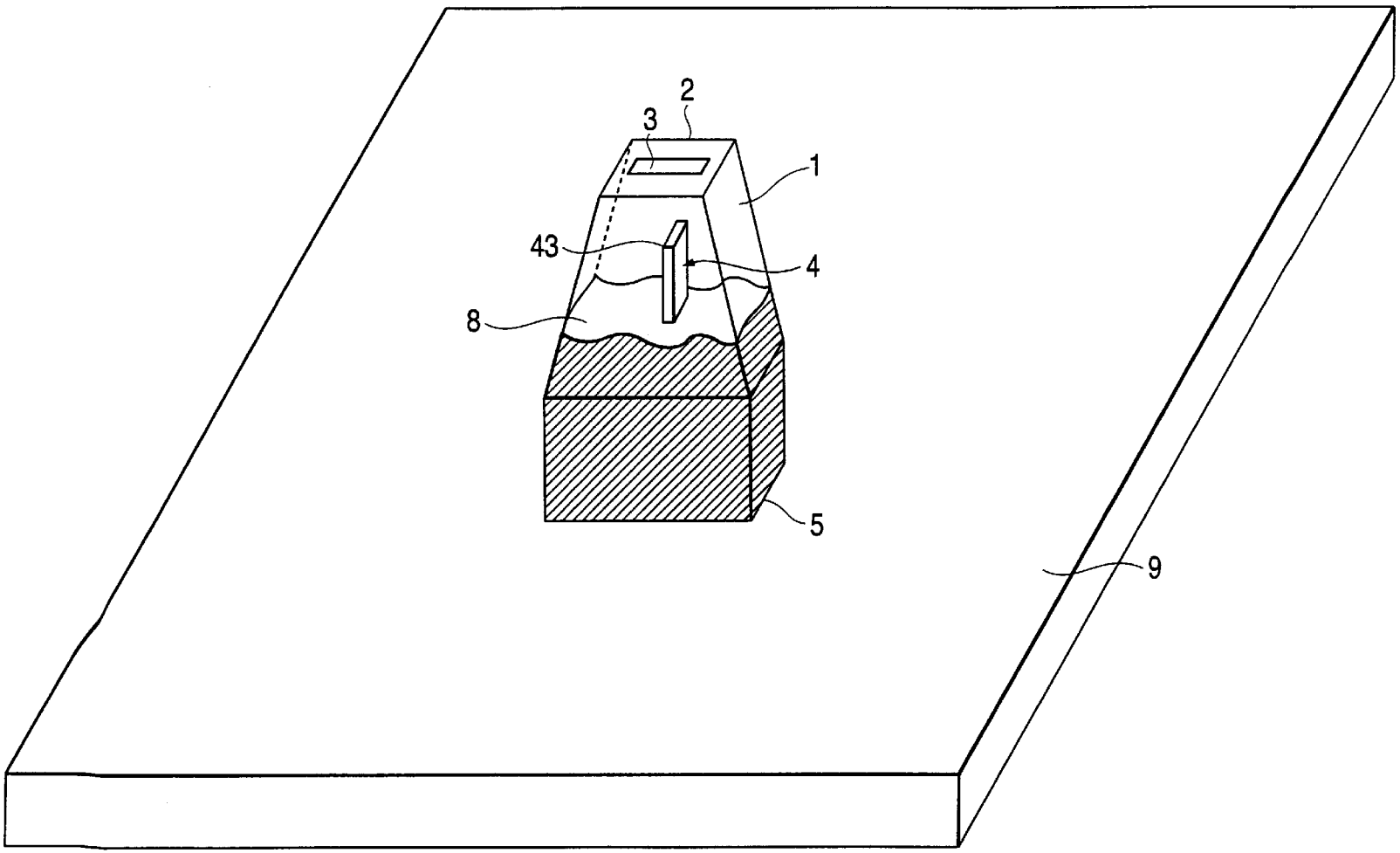
FIG. 3 is a perspective view showing a state wherein the toner cartridge 1 is let stand on a storage surface.

Now, one embodiment of the invention will be described in detail with reference to the accompanying drawings. FIG. 1 is a perspective view illustrating a toner cartridge according to the invention. FIG. 1 omits a toner material for clarifying a toner agitating member 4 attached to the inside of the cartridge for loosening an aggregation of the toner material while illustrating a main body 1*a* of the toner cartridge 1 in perspective. FIGS. 2A and 2B illustrate the toner cartridge 1 in section taken on lines A—A and B—B in FIG. 1, respectively. It is to be noted that FIGS. 2A and 2B are sectional views, each illustrating a state wherein the agitating member 4 of FIG. 1 is replaced by a toner agitating member 4*c* of a construction shown in FIG. 6. Description is given on FIGS. 1, 2A and 2B. The toner cartridge 1 comprises the main body 1*a*, the toner agitating member 4, a support member 1*b* and a restricting member 10. The support member 1*b* comprises a support pin 6 and an engagement member 7.

As shown in FIG. 1, the main body 1*a* of the toner cartridge 1 is a container formed of a resin material and substantially shaped like a box. The main body 1*a* of the toner cartridge 1 is formed with an discharge port 3 at a top surface 2 thereof for supplying a toner feeder with a toner material loaded in the main body 1*a* of the toner cartridge 1. As seen in FIG. 1, the main body 1*a* of the toner cartridge 1 is so constructed as to progressively decrease in width toward the discharge port 3. Thus, as mounted to a hopper of the toner feeder, the toner cartridge 1 is adapted to feed the toner material efficiently. A capacity of the main body 1*a* of the toner cartridge 1 is defined such that the main body provides some room, i.e. a space without toner therein with about 600 cc of toner material loaded therein. The room means space free from the toner material.

The main body 1*a* of the toner cartridge 1 contains therein the toner agitating member 4 of the invention in addition to the toner material. The toner agitating member 4 is formed of a rectangular plate bent into a substantially L-shape in section in a direction parallel to a longitudinal axis of the plate. Provided that the plate is divided into two portions by a line along which the plate is bent, a portion having the smaller length in the direction parallel to the aforesaid axis is referred to as a support plate 41 whereas the other portion having the greater length in the aforesaid direction is referred to as an agitating plate 43. The support plate 41 is attached to a bottom surface of the main body of the toner cartridge 1, i.e., a bottom surface 5 opposing the opening surface 2 on which the discharge port 3 is formed, with the support member 1*b*.

Thus, the toner agitating member 4 is supported so as to pivot about the support pin 6 like a conical pendulum. The toner agitating member 4 is so supported as allowed to move in a direction parallel to the axis of the support pin 6 and also to pivot like a conical pendulum within a range of an inside diameter of a through hole 42. More specifically, the toner agitating member 4 is positioned such that the plate-like agitating plate 43 constituting a longitudinal portion of the L-shaped configuration stands upright within the main body of the toner cartridge 1 and the distal end 50 of the agitating plate 43 is at a predetermined distance from the discharge port 3. Further, the toner agitating member 4 is disposed in such a manner that the opposite side ends of the agitating plate 43 respectively abut against opposite inside walls of the main body 1*a* of the toner cartridge 1 when the toner agitating member 4 pivots like a conical pendulum. Thus, as abutted against the inside walls, the opposite side ends of the agitating plate give vibration to the main body 1*a* of the toner cartridge 1.

Now, a construction for supporting the toner agitating member 4 will be described as below. The support pin 6 fixed to the bottom surface 5 extends through the through hole 42 formed on the support plate 41 of the toner agitating member 4. Attached to a distal end of the support pin 6 is the engagement member 7 for preventing disengagement of the toner agitating member 4. An inside diameter of the through hole 42 is sufficiently greater than an outside diameter of the support pin 6.

The support pin 6 is mounted to a position where the distal end 50 of the agitating plate 43 of the toner agitating member 4 is not aligned with the discharge port 3 in a state of the toner agitating member 4 for toner feeding, i.e., a state in which the discharge port 3 points downward and the toner agitating member 4 is at a standstill. Since the distal end 50 of the toner agitating member 4 is not aligned with the center of the discharge port 3 during the toner feeding, the toner material is smoothly discharged from the discharge port 3 to flow into the toner feeder. More specifically, if the distal end 50 of the plate-like agitating plate 43 of the toner agitating member 4 is relatively shifted from the center of the discharge port 3, the discharge port 3 is not divided into two portions. Therefore, the discharge port 3 is allowed to discharge the toner material without being reduced in its available aperture size. This provides for the prevention of extended feeding time due to the interference of the agitating plate 43.

Furthermore, the toner agitating member 4 is provided in such a manner that, as seen in FIG. 1, a longitudinal direction of a section of the agitating plate 43 parallel to the opening surface 2 (i.e., a width direction of the agitating plate) is orthogonal to a longitudinal direction of the discharge port 3 when the toner is supplied via the discharge port 3. This prevents the distal end 50 of the agitating plate 43 from dividing the discharge port 3 into halves or from closing the port 3. Thus is reduced time required for the toner feeding.

The toner agitating member 4 is allowed to rotate about the support pin 6 and to move in the direction parallel to the axis of the support pin 6. Additionally, the toner agitating member 4 is adapted to make a great pivot about the support pin 6 within an available range. Thus, the pivoting range of the toner agitating member 4 or the moving range thereof covers not less than 33% of the total volumetric capacity of the main body of the toner cartridge 1. More specifically, the main body of the toner cartridge 1 having a construction progressively decreased in size toward the discharge port 3 naturally permits the moving range of the toner agitating member 4 to cover more than 33% of the total volumetric capacity of the main body. Thus an increased agitating efficiency is accomplished.

Figure 9:
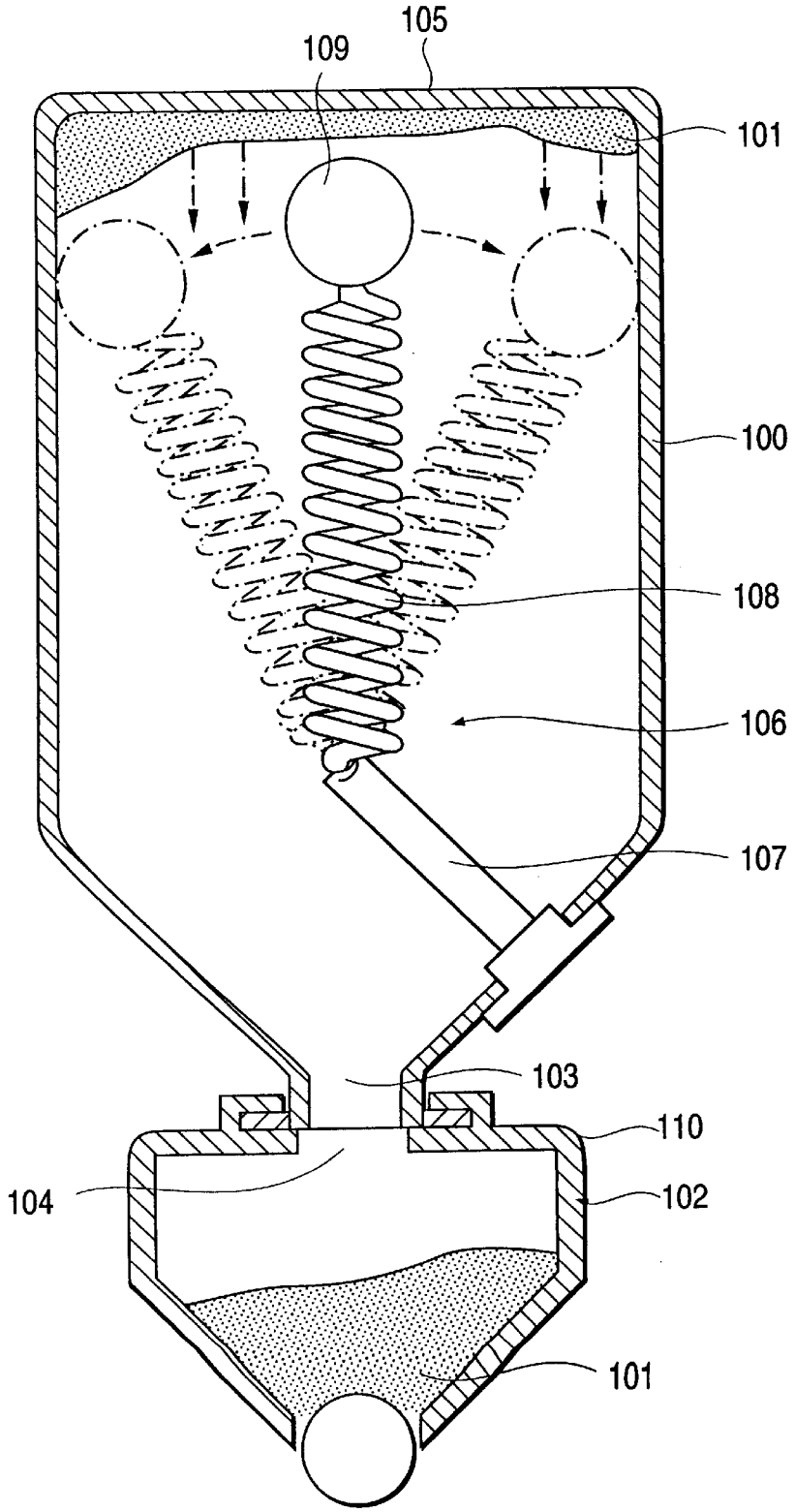
FIG. 9 (PRIOR ART)
FIG. 9 is a sectional view showing a construction of a prior-art toner cartridge and a state wherein a toner material is fed from the toner cartridge to a toner feeder.

Although not shown in FIG. 1, the discharge port 3 is sealed with the sealing member so that the toner material therein is sealed up in the toner cartridge 1. When feeding the toner material to the toner feeder of the construction shown in FIG. 9, the user first directs the opening surface 2 with the discharge port 3 downward to fit the discharge port 3 in an inlet opening of the toner feeder. While maintaining the toner cartridge in this state, the user removes the sealing member closing the discharge port 3. This allows the toner material to flow through the discharge port 3 into the hopper of the toner feeder.

During storage, the toner cartridge 1 of the above construction is normally placed on a storage surface 9 as standing on the bottom surface 5 thereof so that the discharge port 3 is positioned above the bottom surface 5. Lettng the toner cartridge 1 stand in this state over an extended period of time results in the aggregation of toner material 8 contained in the toner cartridge 1. In order to feed such an aggregated toner material 8 from the toner cartridge 1 to the toner feeder, the aggregated toner material must be loosened to restore its inherent properties, particularly fluidity. It is generally known that when aggregated, the toner material behaves like solid matter but as sufficiently loosened, the toner material behaves like a liquid. Therefore, a need exists for adequately loosening the aggregation of toner material in order to provide a quick toner feeding.

In order to adequately loosen the aggregated toner material, the user shakes the toner cartridge 1 vertically and laterally before mounting the toner cartridge 1 to the toner feeder. At this time, the toner agitating member 4, or the agitating plate 43 in particular, within the toner cartridge 1 is pivoted to gradually loosen the aggregated toner material thereby bringing back the toner material to a particle state free from aggregation and thus, a favorable fluidity is restored since the agitating plate 43 is shaped like a flat plate, the movement thereof in a direction of the arrow d2 orthogonal to a thickness direction d1, i.e., a width direction of the agitating plate 43 as seen in FIG. 1 is facilitated. More specifically, since the agitating plate 43 is shaped like a flat plate, a surface with which the agitating plate 43 pushes the toner material 8 during its movement in the width direction d2, or a side surface thereof is narrower than a surface 49 with which the agitating plate 43 pushes the toner material 8 during its movement in the thickness direction d1. Accordingly, at the beginning of the shaking of the toner cartridge 1 containing the aggregated toner material 8, the movement of the agitating plate in the thickness direction d1 is restricted by the toner material but a smooth movement thereof in the width direction d2 is allowed because of its small thickness. That is, the plate-like configuration of the toner agitating member 4 provides a greater effect of loosening the aggregated toner material as compared with the residual toner removing means of the prior-art toner feeder.

Figure 4A:
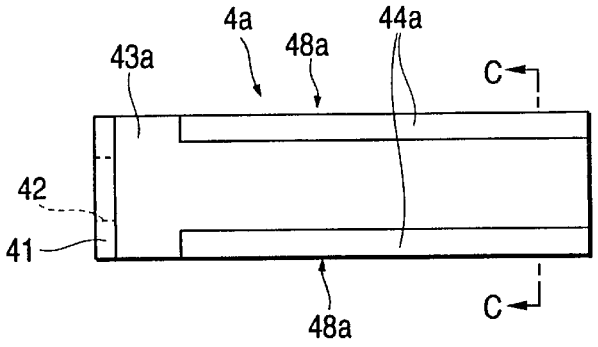
FIG. 4A is a front view showing a toner agitating member 4*a* to be mounted to a main body 1*a* of the toner cartridge 1 instead of a toner agitating member 4 of the toner cartridge 1 of FIG. 1.
Figure 4C:
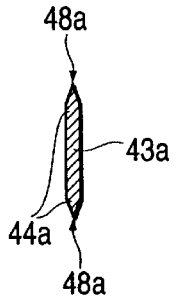
FIG. 4B is a side view of the toner agitating member 4*a* and FIG. 4C is a sectional view of the toner agitating member 4*a* taken on line C—C in FIG. 4A.
Figure 4B:
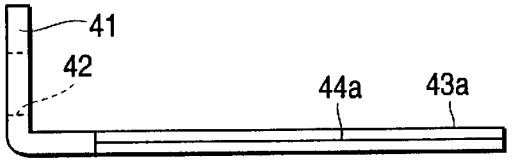

For the same reason, the toner agitating member 4 of FIG. 1 may be replace by a toner agitating member 4*a* shown in FIGS. 4A to 4C, which is pivotally attached to the bottom surface 5 of the main body 1*a* of the toner cartridge 1 with the support member 1*b*. As to the toner agitating member 4*a*, portions of the same shapes as those of the toner agitating member 4 are indicated by the same numerals with descriptions thereof omitted. The agitating plate 43 is a rectangular plate as seen from the front.

As shown in FIG. 4, for example, an agitating plate 43*a* of the toner agitating member 4*a* is configured such that a thickness of opposite end sides 44*a* thereof in the width direction d2 progressively decreases toward opposite side edges 48*a* thereof. In other words, the agitating plate 43*a* has its opposite side ends 44*a* sharply tapered. This allows a smooth movement of the agitating plate 43*a* in the width direction d2 thereby further increasing the effect of loosening the aggregated toner material.

As shown in FIGS. 1, 2A and 2B, a restricting plate 10 may be integrally provided at the bottom surface 5 for effective movement of the agitating plate 43 of the toner agitating member 4 in the width direction d2. More specifically, the restricting plate 10 is disposed in parallel to a plane of the agitating plate 43 in the case that in the toner agitating member 4 is positioned in a state as shown in FIG. 1, and is at a predetermined distance from the position where the support pin 6 is mounted. Hence, the restricting plate 10 restricts partly the rotating range of the toner agitating member 4. The restricting plate 10 is disposed so as to restrict the rotating range of the toner agitating member 4 to about 90°, for example. Therefore, the agitating plate 43 is allowed to rotate clockwise and counterclockwise about the support pin 6 at an angle of about 45°, respectively. As a result, the agitating plate 43 efficiently moves in the width direction d2, thus efficiently crushing and loosening the aggregated toner material by way of the opposite side ends thereof. In this case, the agitating plate 43*a* has their side ends 44*a* sharply tapered, as shown in FIGS. 4A to 4C. This provides an efficient movement of the agitating plate 43 in the width direction d2, particularly an efficient pivotal movement thereof, when the user starts shaking the toner cartridge 1. Thus, the effect of loosening the aggregated toner material is further increased.

When the aforementioned aggregation of toner material is loosened to some degrees, the toner agitating member 4 rotates about the support pin 6. That is, a pivotal movement such as presented by the conical pendulum is added to the movement of the toner agitating member 4 in the width direction d2. Therefore, it is expected that the plane portion 49 of the agitating plate 43 bumps against the toner material 8 which, in turn, resists the movement of the toner agitating member 4 in the thickness direction d1 so that the moving range of the toner agitating member 4 in the thickness direction d1 is reduced. A solution to this problem is to partially cut away the agitating plate 43.

Figure 5A:
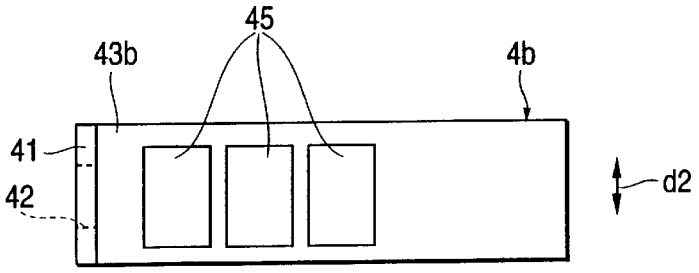
Figure 5B:
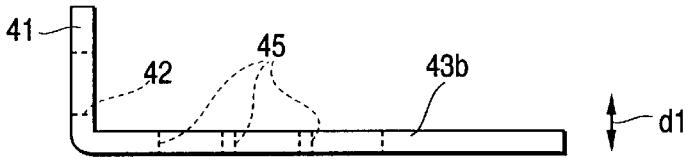
FIG. 5B is a side view of the toner agitating member 4*b;*

Hence, the toner agitating member 4 of FIG. 1 may be replaced by a toner agitating member 4*b* shown in FIGS. 5A and 5B, which is pivotally attached to the bottom surface 5 of the main body 1*a* of the toner cartridge 1 with the support member 1*b*. As to the toner agitating member 4*b*, portions of the same shapes as those of the toner agitating member 4 are indicated by the same numerals with descriptions thereof omitted. An agitating plate 43*b* of the toner agitating member 4*b* is a rectangular plate. Passage holes 45 are formed in the agitating plate 43*b* in the proximity of the support plate 41. The passage holes 45 extend through the agitating plate 43*b* in the thickness direction d1, thus allowing for the passage of the toner material. More specifically, the agitating plate 43*b* includes the passage holes 45 close to the support pin 6 for allowing the passage of the toner material therethrough. Since the plane 49 of the plate-like agitating plate 43*b* is partially cut away, the resistance exerted by the toner material is reduced so that the movement of the agitating plate 43 is facilitated in the thickness direction d1. Thus, the toner agitating member 4*b* is allowed to rotate or pivot in an effective manner thereby achieving a further increased effect of loosening the aggregated toner material.

As the method of cutting away a part of the agitating plate 43, the passage holes 45 may be formed in the agitating plate 43 or otherwise, cut-away portions 46 maybe formed by partially cutting away the opposite side ends of the agitating plate 43 so as to decrease the width of the agitating plate 43 at its longitudinal central portion.

Figure 6A:
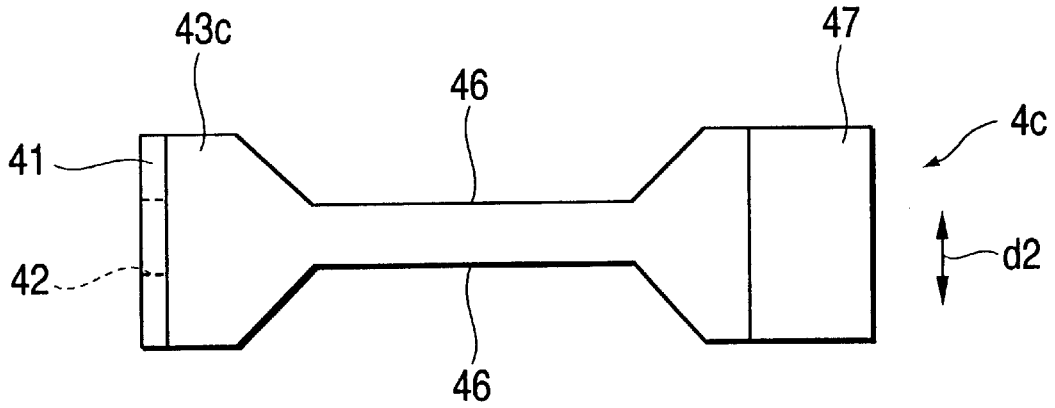
Figure 6B:
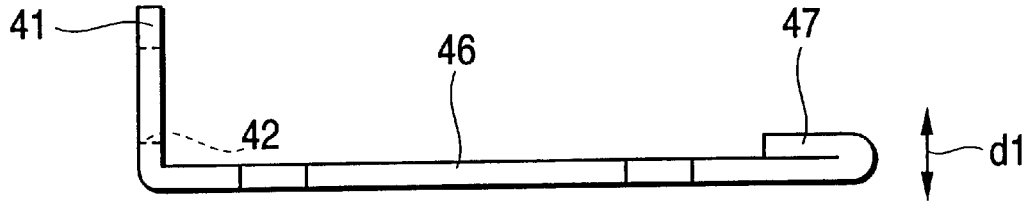
FIG. 6B is a side view of the toner agitating member 4*c;*

More specifically, the toner agitating member 4 of FIG. 1 may be replaced by a toner agitating member 4*c* shown in FIGS. 6A and 6B which is pivotally attached to the bottom surface 5 of the main body 1*a* of the toner cartridge 1 with the support member 1*b*. As to the toner agitating member 4*c*, portions of the same shapes as those of the toner agitating member 4 are indicated by the same numerals with descriptions thereof omitted. An agitating plate 43*c* of the toner agitating member 4*c* is a rectangular plate with the cut-away portions 46 at its opposite side ends, respectively. Since the cut-away portion 46 extends through the agitating plate 43*c* in the thickness direction d1, the toner material is allowed to pass therethrough. Based on a similar reason to the case of the agitating plate 43*b* with the passage hole 45, the toner agitating member 4*c* can present a further increased effect of loosening the aggregated toner material.

In order to provide a more effective movement of the agitating plate 43*c*, the toner agitating member 4*c* may have a weight attached to its end opposite to the support plate 41. For this reason, the agitating plate 43*c* of the toner agitating member 4*c* has its distal end portion folded back for increasing a weight thereat such that a weight 47 is formed at the distal end of the agitating plate 43*c*. As to the portion of the agitating plate 43 other than the distal end portion thereof, the agitating plate 43*c* is decreased in width at the longitudinal central portion thereof for effective movement thereof in the thickness direction d1, as described above. That is, the agitating plate 43*c* is provided with the cut-away portions 46 by symmetrically cutting away a part of the opposite side ends of the longitudinal central portion thereof.

Thus, the weight 47 assists the movement of the agitating plate 43*c* while the cut-away portion 46 reduces resistance of the toner material to the movement of the agitating plate 43*c*. As a result, the agitating plate 43*c* is allowed to pivot efficiently, thereby further increasing the effect of loosening the aggregated toner material.

The toner cartridge 1 of the construction shown in FIG. 2 was prepared to be used in the following test to examine how effectively the toner cartridge 1 of the invention could loosen the toner material. An experimental toner cartridge 1 is loaded with about 600 cc of toner material 8 in the main body 1*a* thereof. Although FIG. 1 and the like illustrate the discharge port 3 smaller than the opening surface 2, in the experimental toner cartridge 1, the discharge port 3 is formed so as to be identical with the opening surface 2 is shape. Inside dimensions of the discharge port 3 is a long dimension of 40 mm and a short dimension of 27 mm. As seen in FIG. 2, the toner cartridge 1 is provided with the toner agitating member 4*c* of configuration shown in FIG. 6.

There was prepared a toner cartridge as a comparative example which comprised only the main body 1*a*, excluding the toner agitating member. A state of loosened toner material in the toner cartridge of the comparative example was examined and compared with that of the experimental toner cartridge. A shaking device shown in FIG. 7 was used to shake the above two toner cartridges. First, the toner cartridge 1 was fixed to one end of a 40 cm-long arm 11 with its discharge port 3 directed upward. An arm 11 has the other end thereof supported on a shaft 12 so as to be allowed to rotate about the shaft 12. The arm 11 is adapted to pivot about the shaft 12 in a cycle of 2 seconds to and fro between a horizontal position and a vertical position reached by an angular displacement of 90°.

Figure 7:
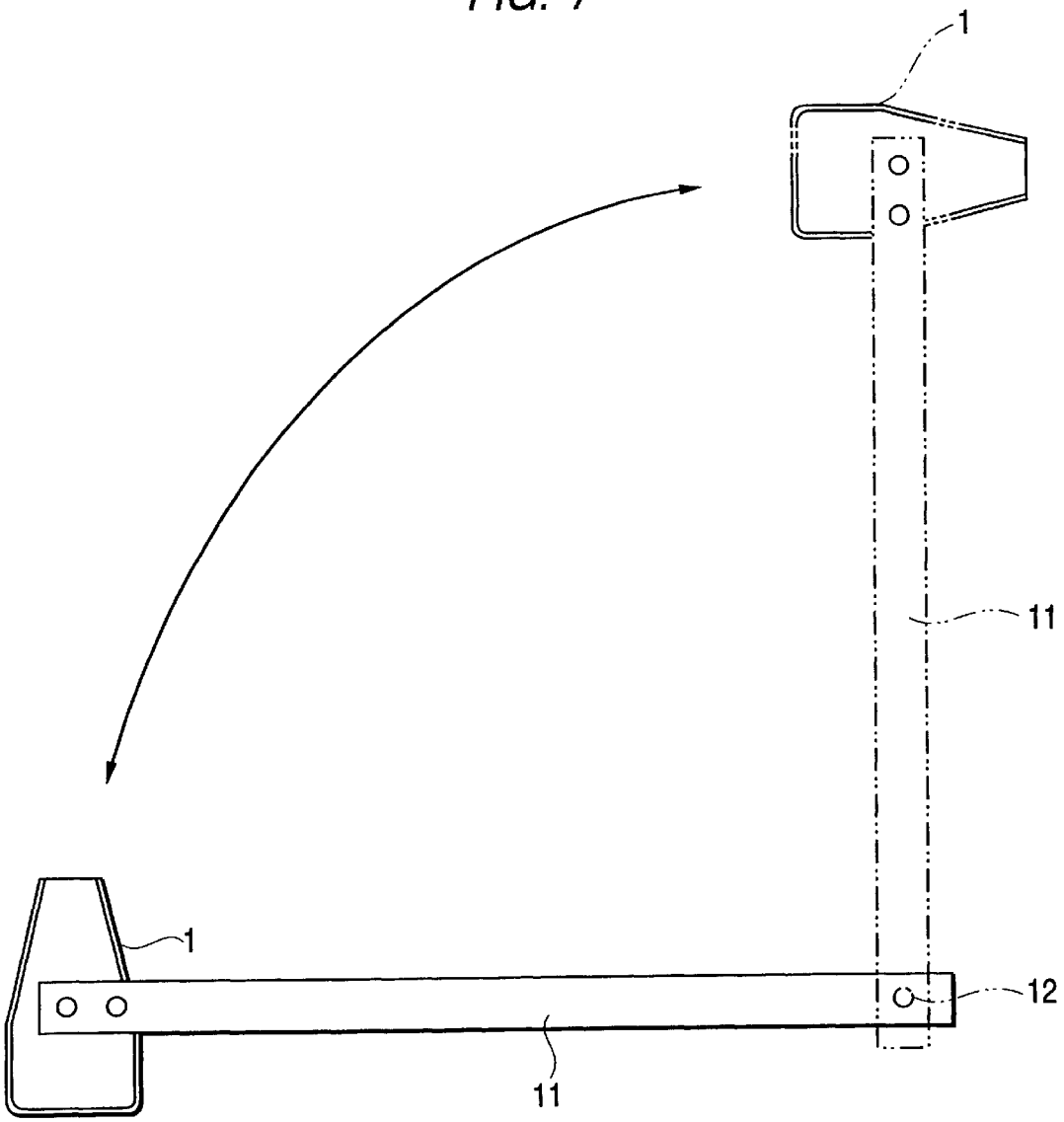
FIG. 7 is a plan view showing a construction of a shaking device used in a test for examination of a toner loosening effect of the toner cartridge in FIG. 1 and adapted to apply oscillation to the toner cartridge for loosening the toner material under given conditions.

The two toner cartridges mentioned above were subjected to five cycles of oscillations by the shaking device of FIG. 7 and then, let stand for 15 seconds. Subsequently, each of the toner cartridges was mounted to the toner feeder to start feeding the toner material and the results were examined. The toner cartridge of the comparative example excluding the toner agitating member 4 took about 65 seconds to transfer all the toner material therein to the toner feeder. In contrast, the experimental toner cartridge 1 including the toner agitating member 4*c* took about four seconds to complete the toner feeding to the toner feeder.

Even if the toner cartridge 1 with the toner agitating member 4, 4*a* to 4*c* according to the embodiments of the invention is let stand over an extended period of time, the toner cartridge can present a greater effect of loosening the toner material than the toner cartridge without the toner agitating member, thus achieving a quick and adequate loosening of the toner material. Additionally, the toner cartridge of the embodiments require much shorter time to feed the toner material to the toner feeder as compared with the toner cartridge without the toner agitating member and hence, allows the user to complete the toner feeding quickly without fear of spilling toner.

Figure 8:
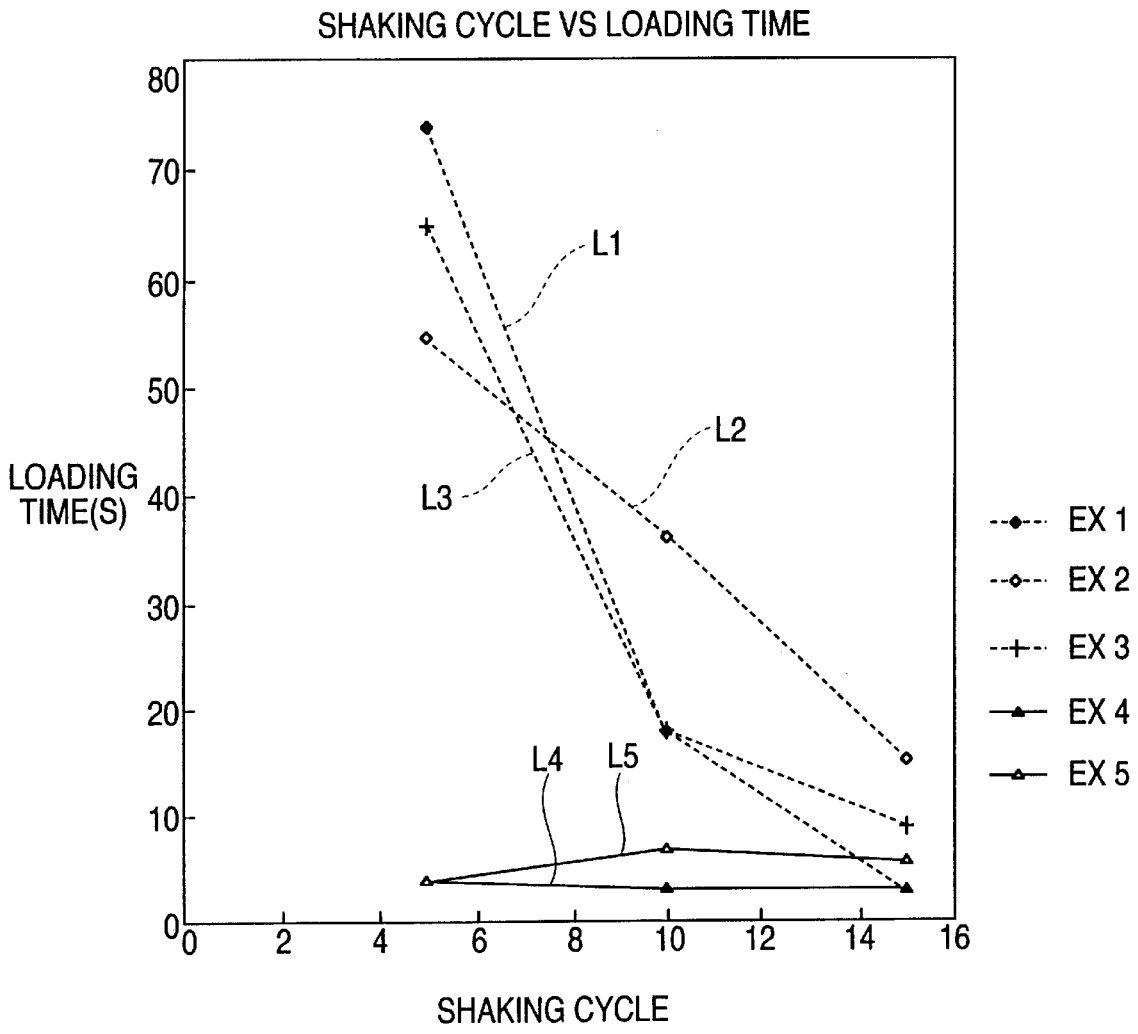
FIG. 8 is a graphical representation of characteristic curves of toner cartridges of the invention and of the prior art, each curve indicating a relationship between a toner-agitating time and time required for feeding a toner from a toner cartridge to a toner feeder.

A plurality of toner cartridges 1 of the embodiment and of toner cartridges without the toner agitating member were prepared respectively. Each of the toner cartridges 1 and the toner cartridges was subject to the aforesaid shaking device to loosen the toner material. FIG. 8 is a graphical representation of a relationship between time required for the toner feeding (ordinate) and cycles of shaking the toner cartridge (abscissa). More specifically, there were prepared three toner cartridges ex1, ex2 and ex3 without the toner agitating member and two toner cartridges ex4 and ex5 with the toner agitating member according to the embodiment hereof. The graph reports the results of a test according to the aforementioned test procedure wherein each of the toner cartridges was subject to the shaking with varied shaking cycles each time and measured for time required to complete the toner feeding. Lines L1 to L5 indicate the aforesaid relationships with respect to the toner cartridges ex1 to ex5, respectively.

It is appreciated from FIG. 8 that if subjected to the shaking device of FIG. 7 for a sufficient period of time to be adequately oscillated, even the toner cartridges ex1 to ex3 without the toner agitating member can adequately loosen the aggregated toner material. Thus, as the number of the aforesaid cycles increases, the time required for the toner feeding decreases. However, in the case of a short period of time for oscillating the toner cartridge, the aggregation of toner material is not adequately loosened, requiring an extended period of time for the toner feeding. Therefore, a fear exists that some user may mistakenly remove the toner cartridge from the hopper of the toner feeder in the course of toner feeding so as to scatter the toner material around.

As apparent from FIG. 8, the toner cartridge 1 including the toner agitating member 4 and 4*a* to 4*c* according to the embodiments hereof is capable of adequately loosening the aggregated toner material through a short shaking process by means of the shaking device of FIG. 7, thus accomplishing a notable reduction of time required for the toner feeding. FIG. 8 also shows that regardless of the duration of the shaking operation, the toner cartridge 1 according to the embodiments hereof requires a substantially constant period of time for the toner feeding. Therefore, despite a short duration of the shaking operation, the toner cartridge of the invention accomplishes an adequate agitation of the toner material so as to reduce time for the toner feeding. Although the degrees of shaking vary depending upon individual users, the user needs only a short period of time to feed the toner material even if the toner cartridge has been shaken for a short period of time. The toner feeding time is constant regardless of the shaking time.

As described in the foregoing, the toner cartridge for replenishing the toner feeder with the toner material according to the invention utilizes a simple, inexpensive and trouble-free mechanism for quickly loosening the aggregation of toner material formed due to the gravity while the toner cartridge has been left standing over an extended period of time. This assures a quick toner feeding to the toner feeder for prevention of toner feeding failure. As a result, a significant reduction of time required for feeding the toner material to the toner feeder is accomplished thereby dramatically reducing efforts paid by the user. This also leads to the elimination of troubles such as toner scattering and the like and hence, the contamination of the users' hands or clothes with the toner material is prevented.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge provided with a container for storing a toner material therein for feeding the toner material to a development device of an electrophotographic type image forming apparatus, the toner cartridge comprising:

a toner agitating member housed in the container, having a plate-like agitating plate, the toner agitating member including an integral portion formed at a substantially fixed right angle to the plate-like agitating plate; and a support member attached to an inside of the container for supporting the toner agitating member so as to allow a first end of the agitating plate to pivot, wherein a discharge port for discharging the toner material out of the container is formed on the container, and wherein shaking the container causes a second end of the agitating plate to pivot on said first end acting as a fulcrum.

2. The toner cartridge of claim 1, wherein the support member is attached to a bottom surface of the container opposite to the discharge port thereof and adapted to support the toner agitating member in a manner that the agitating plate is caused to pivot on the first end of the agitating plate like a conical pendulum while the second end thereof is opposed to the discharge port.

3. The toner cartridge of claim 1, wherein a part of the agitating plate is cut away.

4. The toner cartridge of claim 1, wherein the toner agitating member has a centroid shifted closer to a vicinity of the second end of the agitating plate.

5. The toner cartridge of claim 1, wherein a passage hole is formed in the proximity of the first end of the agitating plate, the passage hole penetrating the agitating plate in a thickness direction thereof.

6. The toner cartridge of claim 1, wherein the container has such a cross-section parallel to the discharge port as progressively decreases toward the discharge port.

7. The toner cartridge of claim 1, wherein the toner agitating member is supported in such a manner that the agitating plate pivots so that the first end of the agitating plate is abutted against the container.

8. The toner cartridge of claim 1, wherein the plate-like agitating plate is longer than the integral portion.

9. The toner cartridge of claim 1, further including means for causing the toner agitating member to rotate.

10. A toner cartridge provided with a container for storing a toner material therein for feeding the toner material to a development device of an electrophotographic type image forming apparatus, comprises:

a toner agitating member housed in the container, having a plate-like agitating plate;

a support member attached to the inside of the container for supporting the toner agitating member so as to allow a first end of the agitating plate to pivot; and a restricting plate for restricting a range of pivotal movement of the agitating plate, wherein a discharge port for discharging the toner material out of the container is formed on the container, and wherein shaking the container causes a second end of the agitating plate to pivot on said first end of the agitating plate acting as a fulcrum within the range defined by the restricting plate.

11. The toner cartridge of claim 10, wherein the toner agitating member is supported in such a manner that a width direction of the agitating plate is orthogonal to a longitudinal direction of the discharge port and that the restricting plate restricts the range so as to allow the agitating plate to move in the width direction thereof.

12. The toner cartridge of claim 1 or 10, wherein the toner agitating member is supported in such a manner that when the toner agitating member stands still, the second end of the agitating plate opposes a portion of the discharge port wherein the agitating plate can move from the vicinity of the center of the discharge port.

13. A toner cartridge provided with a container for storing a toner material therein for feeding the toner material to a development device of an electrophotographic type image forming apparatus, the toner cartridge comprising:

a toner agitating member housed in the container, having a plate-like agitating plate; and a support member attached to an inside of the container for supporting the toner agitating member so as to allow a first end of the agitating plate to pivot, wherein a discharge port for discharging the toner material out of the container is formed on the container, and wherein shaking the container causes a second end of the agitating plate to pivot on said first end acting as a fulcrum, wherein the agitating plate has side ends in a width direction thereof formed thinner and sharper than a central portion of the agitating plate.

14. A toner cartridge provided with a container for storing a toner material therein for feeding the toner material to a development device of an electrophotographic type image forming apparatus, the toner cartridge comprising:

a toner agitating member housed in the container, having a plate-like agitating plate; and a support member attached to an inside of the container for supporting the toner agitating member so as to allow a first end of the agitating plate to pivot, wherein a discharge port for discharging the toner material out of the container is formed on the container, and wherein shaking the container causes a second end of the agitating plate to pivot on said first end acting as a fulcrum, wherein a cut-away portion is formed on a longitudinally central part of the side ends of the agitating plate, the cut-away portion penetrating the agitating plate in a thickness direction thereof.

15. A toner cartridge provided with a container for storing a toner material therein for feeding the toner material to a development device of an electrophotographic type image forming apparatus, the toner cartridge comprising:

a toner agitating member housed in the container, having a plate-like agitating plate; and a support member attached to an inside of the container for supporting the toner agitating member so as to allow a first end of the agitating plate to pivot, wherein a discharge port for discharging the toner material out of the container is formed on the container, and wherein shaking the container causes a second end of the agitating plate to pivot on said first end acting as a fulcrum, wherein the toner agitating member further includes a support plate mounted to the first end of the agitating plate and provided with a support hole penetrating through the support plate in a thickness direction thereof, wherein the support member includes a support pin having one end attached to the surface of the container opposite to the discharge port, and an engagement member attached to the other end of the support pin, and wherein the support pin has an outside diameter smaller than an inside diameter of the support hole and a length greater than the thickness of the support plate.

* * * * *